US005957354A

United States Patent [19]

Mentken

[11] Patent Number: 5,957,354

[45] Date of Patent: Sep. 28, 1999

[54] BACKSACK

[76] Inventor: Robert Mentken, 51 E. 97th St, (Apt.4A), New York, N.Y. 10029

[21] Appl. No.: 09/012,933

[22] Filed: Jan. 24, 1998

Related U.S. Application Data

[63] Continuation-in-part of application No. 08/723,394, Sep. 30, 1996, abandoned.

[51] Int. Cl.[6] ..... A45F 3/04

[52] U.S. Cl. ..... 224/614; 224/627; 224/637; 224/606; 224/601; 24/459; 24/200; 24/163 R

[58] Field of Search ..... 224/600, 606, 224/607, 608, 613, 614, 615, 616, 617, 618, 619, 627, 637, 639, 645, 655, 656, 601; 24/459, 200, 163 R

[56] References Cited

U.S. PATENT DOCUMENTS

| | | | |
|---|---|---|---|
| 1,436,684 | 11/1922 | Rosenband | 24/265 AL |
| 1,510,415 | 9/1924 | Pierce | 224/618 |
| 1,717,295 | 6/1929 | Wolf | 24/265 AL |
| 2,236,199 | 3/1941 | Petersen | 224/616 |
| 2,435,082 | 1/1948 | Huber | 24/459 |
| 3,001,566 | 9/1961 | Lipsitz | 224/616 X |
| 3,882,914 | 5/1975 | Strutz | 224/613 X |
| 4,213,549 | 7/1980 | Hibbard | 224/601 |
| 4,974,709 | 12/1990 | Furlow et al. | 383/76 |
| 4,978,044 | 12/1990 | Silver | 224/615 |
| 4,988,216 | 1/1991 | Lyman | 383/76 |
| 5,033,170 | 7/1991 | Ewert | 24/459 |
| 5,557,830 | 9/1996 | Davis | 24/459 |
| 5,570,828 | 11/1996 | Lewis | 224/627 |

FOREIGN PATENT DOCUMENTS

| | | | |
|---|---|---|---|
| 1070970 | 8/1954 | France | 24/459 |
| 693272 | 6/1940 | Germany | 224/209 F |
| 1040473 | 10/1958 | Germany | 24/459 |
| 244216 | 8/1946 | Switzerland | 224/613 |

*Primary Examiner*—Gregory M. Vidovich

[57] ABSTRACT

A backsack (48) comprises a bag (51 ), a strap (30), a pair of robust ring spring clips (38, 66) and generally four pellets (26, 28). The bag is folded and glued of a single sheet of printable paper-like, yet high-strength material to have side gussets (55) and a flat bottom (52). The flat bottom (52) comprises folded and glued flaps (21, 23) which advantageously form corner pockets (22). The top of the bag is turned (87), with reinforcements affixed under the cuff. Two holes (88) are punched through all four layers of the collapsed bag resulting in eight holes (88) when the bag is open. With the bag still collapsed, the strap (30) is threaded through one of the two holes, back through the other, and serves as a closure at the top, leach of the two equal length portions of the strap (30) emerges from its hole and loops down to form shoulder loops. A pellet (28) is placed into each bottom corner pocket (22). The coils of the pair of ring spring clips (40, 42 and 68, 70) are pried apart with a tool (34). Each corner with its pellet within (27) is inserted between the open coils, and the tool (34) is withdrawn, allowing the coils to close, trapping the pellets (28) along with the bag corners (27) within its open center (44). The straps can be attached to the opposite side of the coils using the same pellet method, or by other methods. An alternative combination clip provides cinch-type strap adjustability. Backsacks can be made to have one or two straps for one or two shoulder use, and an auxiliary (80) or integral (81) waist strap, and fixed or adjustable, auxiliary or integral foul weather protection (86, 89, 90, 91, 92).

27 Claims, 7 Drawing Sheets

BACKSACK

This application is a Continuation-In-Part of application Ser. No. 08/723,394 entitled "LOW-COST, ONE-COMPARTMENT STITCHLESS BACKSACK" filed Sep. 30, 1996, now abandoned.

BACKGROUND

1. Field of Invention

This invention relates to backpacks, particularly to simple, inexpensive single-compartment backpacks.

2. Prior Art

A typical low-cost, one-compartment backpack is a sewn cloth bag with a drawcord closure. The two strands of the drawcord that emerge from the closure sleeve on top are attached, usually by knots and grommets, to the lower corners of the bag, thus forming shoulder loops. Cord length is adjusted by retying the knot elsewhere on the cord.

Painful cords.

As the load increases in weight, these cords become painful on the wearer's shoulders. Although some bags of this kind use flat webbing straps to avoid this problem, friction makes them clumsy to open and close, and no strap adjustability is provided, since straps make extremely unsatisfactory knots. They are simply sewn into the hem.

A waist cord attempt.

Although most drawcord type backpacks do not provide a waist cord, U.S. Pat. No. 4,674,664 to J. D. Simon (June 1987) shows a way to do this. However, not only does this bag need the usual reinforcing, grommeting, and sewing to assemble, but in addition, four separate cords need to be tied together in a complex configuration, two of them threaded through the closure sleeve in opposite directions. Clearly, this much hand assembly is expensive. Moreover, this bag does not solve the problem of painful cords since its intended use is carrying only the few lightweight personal effects needed by runners, bicycle riders, skiers, etc. Neither is there any interest in, nor attempt to provide a display area, or foul weather protection. On the contrary, the preferred embodiment calls for an open mesh material.

The "bunching-up" factor.

Whatever the materials used, all drawcord bags have a serious built-in contradiction; their tops bunch up into an ugly knob when drawn closed, and the heavier the material used, the bigger the bunch, and the less adequate is the closure, because of the center hole it forms, which can never be closed completely. The use of flat straps only exacerbates this problem.

Furthermore, the bunching obscures any graphics that might be imprinted on the upper portion of the bags, limiting its useful display area to the lower portion.

These drawcord-type bags often have a weather flap sewn on the back to cover the center hole that remains after closure. The loose end of this weather flap is attached to the front of the bag with one or two buckles, all of which puts the bag into a higher price category. This flap usually covers the drawcord in use, which therefore cannot be used as shoulder straps, so another set of straps must be sewn on for that purpose, adding to the complexity—and cost.

A single strap attempt

Attempts have been made to use a single strap for both closure and shoulder use. (German patent 693,272 to E. Weber (July 1940) shows such a single strap, but to work properly, the strap has to remain so narrow that it provides hardly any advantage over a cord for pain-free portaging. Besides, the bag clearly requires expensive hand construction by sewing, grommeting, etc., as does every other conventional backpack.

The limitations of sewing.

All other factors being equal, backpacks that must be entirely sewn together cannot be made as cheaply in large quantities as ones that can be produced without the need for any sewing whatsoever—especially with high speed automatic equipment performing most of the task.

Furthermore, sewing is actually destructive, since it repeatedly penetrates the bag material, thereby weakening it. That is one reason why most available low-cost backpacks don't last. They are not reinforced at stress points, since this would raise the price.

The peel-stress factor.

U.S. Pat. No. 4,273,274 to M. S. Freistadt (June 1981) shows a handbag that is convertible to a backpack. Its convertibility notwithstanding, this bag fails as a backpack for these reasons:

First, this entirely sewn—therefore comparatively expensive—bag shares the major pitfall of all sewn backpacks that rely solely on strap fastening points that originate on the same side of the bag that the bearer occupies; these sewn connections must alone withstand the enormous peel forces this type of design generates. In use, the bag is pulled in one direction, the straps in another, and only the first stitch in a row of stitches holds them together. Unless heavily reinforced at additional cost, that first stitch at the point of greatest stress fails, then the next, and the next, etc. Second, the crossed straps over the bag top may provide some measure of security for large objects contained in the bag, but very little for smaller ones, and none for any object that requires protection from foul weather.

Backpacks not used as promotion bags.

Inexpensive bags are widely used for promotion purposes, so their utility, relative low price, and ability to bear an image are important. The flexible woven fabrics used for drawcord bags have too coarse a surface for fine printing. Besides, these materials cannot be handled by standard high-efficiency printing presses, so graphics are limited to the relatively slow screen printing of flat, crude images, like logos. Better—but by no means fine—printing is being done on plastic bags of this type, which are heat-sealed together, but these tend to be too lightweight for even moderate and repeated portaging.

Whatever the graphics imprinted on them, since conventional tote bags are carried down, at or below knee height, any graphics they bear are poorly displayed well below eye level. On the other hand, any imprinted backpack, low-cost or otherwise—in theory—provides superior eye-level display. But, although widely available for this purpose through advertising specialty distributors, they are conspicuously unpopular as promotion bags because even the moderately good ones are too expensive, the images they can bear are too crude, and the display area is too small.

The lack of well-printed bags for children.

Many parents of early school-age children want their offspring to be comforted by an image of a beloved media character accompanying them when they go to school. Backpacks with cartoon characters on them are available, but their high prices, poor choice of characters, and poor quality keep them from being popular. One reason they are expensive is that the methods used to apply the images onto materials that are suitable for sewing are costly. Another reason is these bags tend to be bulky and occupy too much valuable store space. Store buyers tend to order them only for the "back-to-school" season, when interest is greatest. Even then, expecting sluggish sales, buyers are careful not to over-order, so choice of characters is limited. The images themselves tend to be small and unappealing because they must, of necessity, be confined to one or two panels of the several these sewn bags comprise.

Quality versus graphics.

As children grow through their school years, so does their need for sturdier, more durable backpacks. Given the limitations of sewing technology, this necessary added value inevitably leads to not only higher prices, but an abandonment of another value, visual appeal. Available backpacks are monochrome, and dull to look at. Images on them are relegated to small sewn-on embroidered patches, or at most, a change of fabric color from panel to panel in an attempt to brighten them. Some backpacks are made of embroidered, or otherwise patterned fabrics, but these sacrifice sturdiness, and cost no less. There have been no visually appealing backpacks that are also durable, and low cost.

Quality versus ease-of-use.

Certain large segments of the population, such as non-driving city dwellers, have a greater need to carry things unassisted, so the methods they use are significant. One such growing segment is the independent elderly, who have trouble dealing with their everyday carrying needs. Hands-free portaging is a necessity for them, since they need to hold on to supports in order to keep balance, push elevator buttons, handle keys, wallets, purses, cards, etc., so backpacks are potentially extremely useful to them. But, such older persons wearing backpacks are hardly ever seen. One reason for this is the available backpacks of even moderate capacity and reasonable quality are too expensive due to their complex, reinforced construction, and they weigh too much. Another reason is they are difficult for the elderly to use. Inexpensive backpacks are usually just a flat cloth sack without side walls, or a floor. Consequently, they have no structure that would enable them to stand up unsupported, so loading can be clumsy. After loading, the user has to first pull and tie the drawcord, buckle the flap, and then make twisting overhead, or behind-the-back moves to put the bag on, and then reverse these steps prior to unloading. All these efforts are hardly worthwhile for a short trip to the store for a few items, even for a young and agile person.

OBJECTS & ADVANTAGES

Accordingly, I claim the following as objects and advantages of my invention: to provide improved one-compartment inexpensive backpacks that are easy to put on and take off;

operate with straps that are adjustable;

use flat straps for shoulder comfort:

have large, uninterrupted wrap-around printing surfaces that accept fine printing;

can be economically printed by various methods in large or smaller quantities;

give superior eye-level visibility to graphics in use;

have straps that perform both the carrying and closing functions;

provide superior, flat, neat closure;

can be made without destructive penetration from sewing and grommeting;

are sturdier and longer-lasting than comparably priced sewn backpacks;

can be economically made by rapid automatic machinery in large quantities;

can be economically made by hand in smaller quantities;

are produced in compact, flat, stock-keeping units;

have flat bottoms, enabling them to stand up unsupported for loading and unloading.

provide integral or auxiliary foul weather protection.

can be worn on one or both shoulders.

Other objects and advantages are to provide backpacks that:

can be made of recyclable materials;

utilize the exceptional tensile strength of certain available paper-like materials that were never before used for this purpose.

Further objects and advantages of my invention will become apparent from a consideration of the drawings and ensuing description.

DRAWING FIGURES (In these drawings, closely related figures have the same numbers, but different alphabetic suffixes)

FIG. 1*a* shows a ¾ perspective rear view of a fully open flat-bottom backsack assembly in accordance with the invention.

FIG. 1*b* is an enlarged view of the area delineated by a broken line circle in FIG. 1*a*.

FIG. 1*c* shows delineated area by broken line circle in FIG. 1*a* with rivet 57 as alternative to pellet 26 within folded strap 30.

FIG. 1*d* shows delineated area by broken line circle in FIG. 1*a* with strap 30 looped around and sewn to straight portions of an alternative spring clip.

FIG. 1*e* shows delineated area by broken line circle in FIG. 1*a* with a double folded and sewn strap end trapped by an alternative spring clip with straight portions.

FIG. 2 shows a front perspective view of a flat-wire, Z-type split ring spring clip in use with a breakaway cross-section of a gripper portion gripping a bag corner with a pellet trapped within its fold in accordance with the invention.

FIG. 2' is an enlarged view of the area delineated by a broken line circle in FIG. 2.

FIG. 2*a* shows a side elevation of a flat-wire, Z-type spring clip (left) and a coil spreader tool (right) in position to enter between the coils in accordance with the invention.

FIG. 2*b* shows a side elevation of the same coil spreader tool (right), as seen in FIG. 2*a*, already entered between the coils of a flat-wire, Z-type spring clip (left), also as seen in FIG. 2*a*, with the coils partially spread and aligned with Notch 36 on the coil spreader tool.

FIG. 2*c* shows a perspective view of the coil spreader tool (also shown in FIGS. 2*a* and 2*b*) rotated ¼ turn with its notches 35 and 36 engaging and fully spreading the coils of the flat-wire, Z-type spring clip of FIG. 2, which is shown here in partial cross-section.

FIG. 3 shows a perspective view of a round wire spring clip in use with a breakaway cross-section of a gripper portion gripping a bag corner with a pellet trapped within its fold in accordance with the invention.

FIG. 3*a* shows a side elevation of the round wire spring clip of FIG. 3.

FIGS. 4*a*, 4*b*, 4*c*, 4*d*, 4*e*, and 4*f* show in perspective the sequence of a strap end, and a flat bottom backsack corner being attached to a spring clip with the use of two pellets and a coil spreader tool.

FIG. 4*g* shows a perspective view of an unopened flat bottom backsack with its strap attached at both rear corners in accordance with the invention, and a broken line circle indicating the area of one of the attachment sites shown in detail in FIG. 4*f*.

FIG. 5*a* shows a perspective view of an auxiliary waist strap in accordance with the invention.

FIG. 5*b* shows a perspective view of a one-piece integral shoulder and waist strap with a front closing buckle, an alternative embodiment.

FIG. 5*c* shows a perspective view of a one-piece integral shoulder and waist strap with a side attaching clip, a variation on the alternative embodiment of FIG. 5*b*.

FIG. 6 shows a perspective view of a partially open pinch-bottom type backsack with its strap attached, and a broken line circle indicating the area shown in detail in FIGS. 6*a*, and 6*b*.

FIG. 6*a* is a detailed perspective view of the indicated corner of FIG. 6 in the heat-sealed version of the pinch-bottom backsack.

FIG. 6*b* shows a detailed perspective view of the indicated corner of FIG. 6 in the glue flap version of the pinch-bottom backsack.

Figure 11:
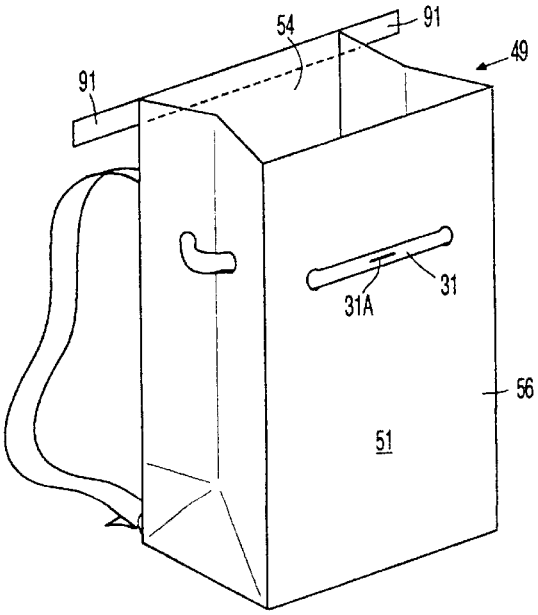
FIG. 11 shows a front perspective view of an alternate long neck version of a flat bottom backsack with a tin-tie attached to the top, rear of its rear panel in accordance with the invention.
Figure 11A:
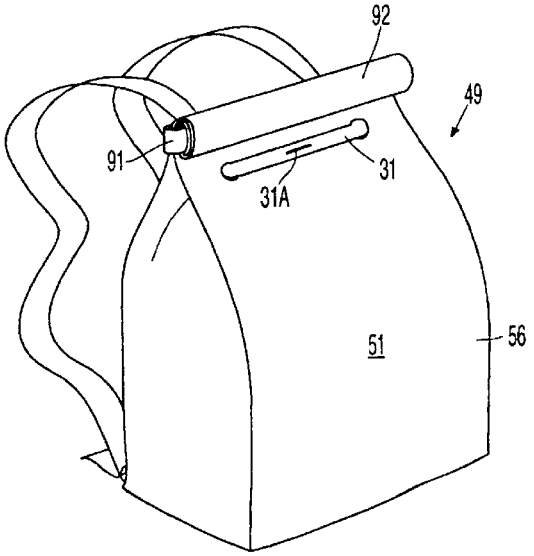

FIG. 11*a* shows a front perspective view of the tin-tie version backsack of FIG. 11, but filled, and with its neck rolled up, serving as an integral foul weather flap, and its tin-tie tabs folded rearward, to hold it closed.

Figure 12:
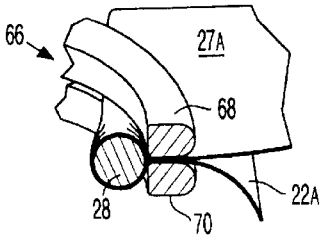

FIG. 12 shows a front perspective breakaway cross-section view of a flat-wire spring clip gripping a pellet trapped in an interior fold of a bag that has no exterior pockets.

Figure 13:
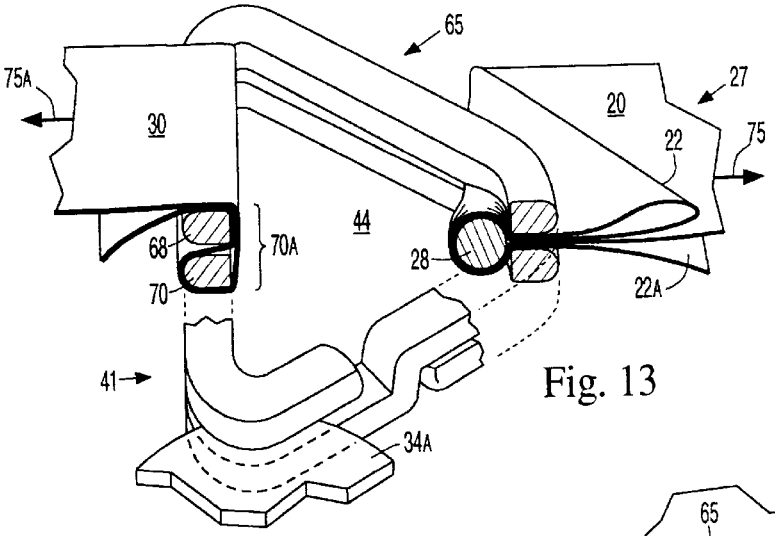

FIG. 13 shows a front perspective breakaway cross-section view of a combination cinch-type strap attachment flat-wire, Z-type split ring spring clip gripping a pellet trapped in an interior fold of a bag on the right, and a strap attached on the left. The edge of a coin is shown separating the coils.

Figure 13A:
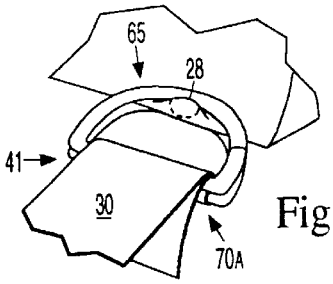

FIG. 13*a* shows a breakaway perspective view of combination cinch-type split ring spring clip 65 similar to that shown in FIG. 13, but having a D shape.

Figure 14:
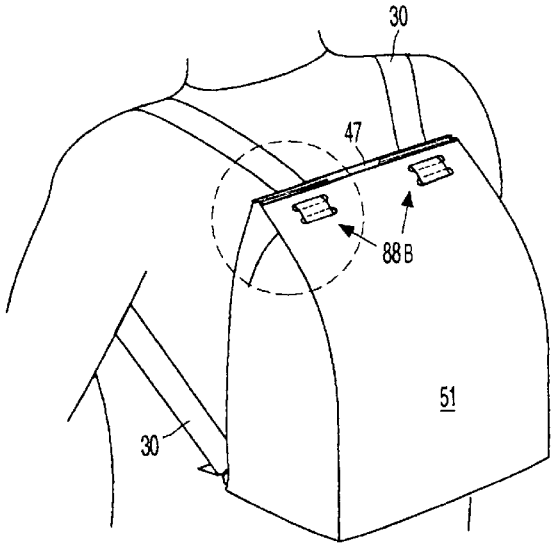

FIG. 14 shows a two-strap embodiment in which each strap is threaded through double slots at the bag top and terminates inside the bag.

Figure 14A:
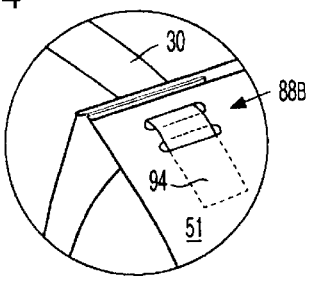

FIG. 14*a* shows delineated area by broken line circle in FIG. 14 of the strap emerging from one slot, re-entering an adjacent slot, and terminating by being glued inside the bag wall.

Figure 14C:
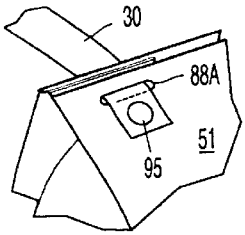
Figure 14B:
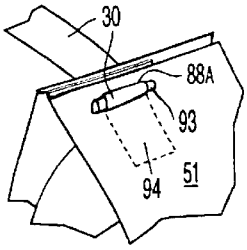

FIG. 14*b* shows an alternative embodiment of the strap emerging from a single slot, wrapping around a peg, re-entering the slot and terminating by being glued inside the bag wall.

FIG. 14*c* shows an alternative embodiment of the strap emerging from a single slot and terminating outside the bag with a rivet.

Figure 15:
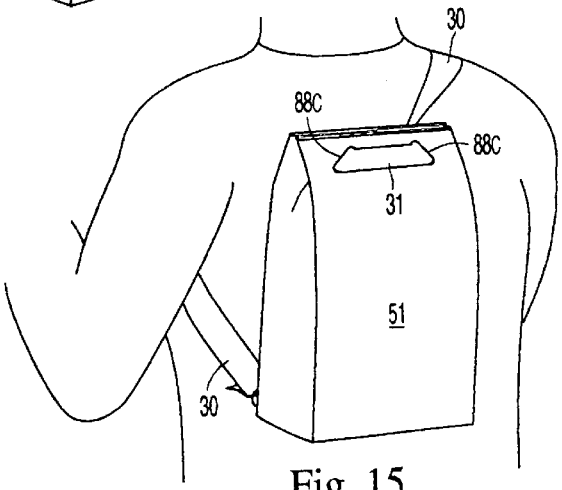

FIG. 15 shows a front view of a one-strap/one shoulder embodiment of the invention being worn on a person's back.

Figure 15A:
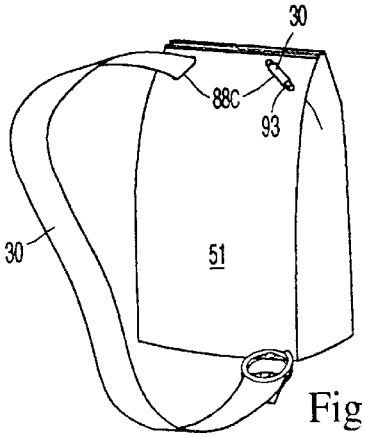

FIG. 15*a* shows a rear view of the same bag as FIG. 15, but without the wearer.

SUMMARY

A backsack in accordance with the invention comprises a folded and glued printable bag made of high-strength materials, with a flat bottom, a reinforced, turned top with a set of holes punched through, and a strap that passes through the holes to serve as closure for the bag, and to form a pair of shoulder loops. These loops connect to the bottom bag comers with a pair of clips, which are basically two-coil extension springs, and are constructed and operate as follows: Small objects, or pellets are placed into corner pockets at the bottom of the bag. The coils of the spring clips are separated with a tool. The pellet-containing corner pockets are placed between the coils, which are trapped when the coils are allowed to close on them. The hidden pellets provide enlarged portions, or bumps, that captivate the clips, preventing their withdrawal from the bag under high tension when the backsack is in use. Straps can be attached to clips using the same pellet method, or various alternative methods, one of which is a combination pellet/cinch clip that permits easy strap length adjustment. Straps can be single and continuous for one or two shoulder use, or double for two shoulder use. Various integral or auxiliary waist straps and foul weather protection options are provided.

DESCRIPTION (FIGS. 1*a*, 4*a*–4*f*, 5*b*, 5*c*, 13, and 15*a*)

Figure 1A:
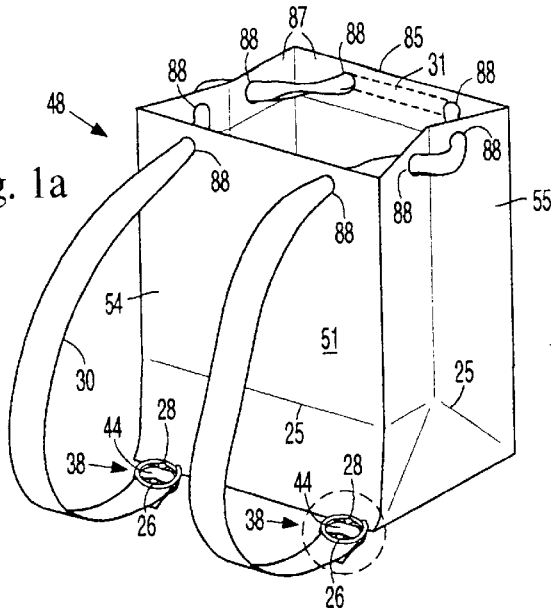
Figure 1B:
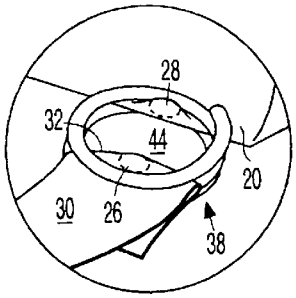

FIG. 1*a* shows a perspective rear view of a typical backsack assembly 48 which comprises a flat-bottomed bag 51, a strap 30, which passes through eight holes 88 at the reinforced top of bag 51 to form a pair of shoulder loops. FIG. 15*a* shows the one-shoulder loop embodiment. Straps generally terminate at the bag's bottom corners unless a waist strap is desired, in which case an extra long strap 81 can pass through clip[s] 38 for this purpose (FIGS. 5*b* and 5*c*). FIG. 1*b* shows strap 30 attached at strap fold 32 to spring clip 38, which is, in turn, attached to bag corners 20. This is accomplished when spring clip 38 captivates between its double coils and within its perimeter pellet 26 (FIG. 1*b*) or other articles (FIGS. 1*c*, 1*e*), and pellet 28 inside its corresponding bag bottom corner pocket 22 (FIGS. 4*a*–4*f*), thereby connecting straps to the bag. Pellet 28 is under the bag material and hence seen as a small bump, as is pellet 26, when used inside strap fold 32.

Figure 1E:
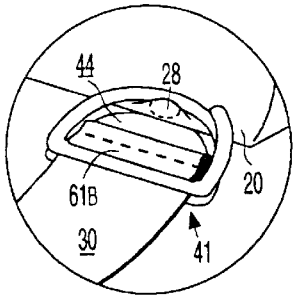
Figure 1C:
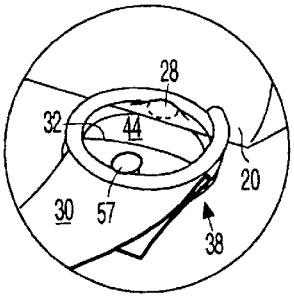
Figure 1D:
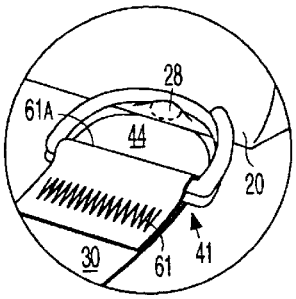

Although the use of a pellet inside the strap fold is the preferred embodiment, more conventional alternative strap-to-clip attachment means are equally effective. Accordingly, FIG. 1*c* shows rivet 57 with raised heads, and FIG. 1*e* shows double folded and sewn raised bead 61B, both providing the necessary purchase against the spring clip coils. FIG. 1*d* shows alternative sewn closed strap loop 61A captivating the spring clip.

Strap length can be adjusted by prying apart the spring clip coils and relocating pellet 26 to another strap fold, however FIG. 13 shows a more easily adjustable cinch-type strap attachment.

The Bags

Flat-bottom bags—FIGS. 1*a*, 4*g*, 8, and 11.

Since the fold-and-glue, flat-bottom construction of bag 51 (FIGS. 1*a* and 4*g*) is well known and widely used in retail trade for shopping and gift bags, in the packaging industry, and by the general public to wrap gift boxes, the general assembly of the present bag is not described. However, FIG. 4*g* shows construction features newly significant to the present backsack, particularly flat bottom 52: Underflaps 23, together with overflaps 21, form pockets 22, which are hidden from view, but advantageously reach rear edge fold 24.

Figure 7:
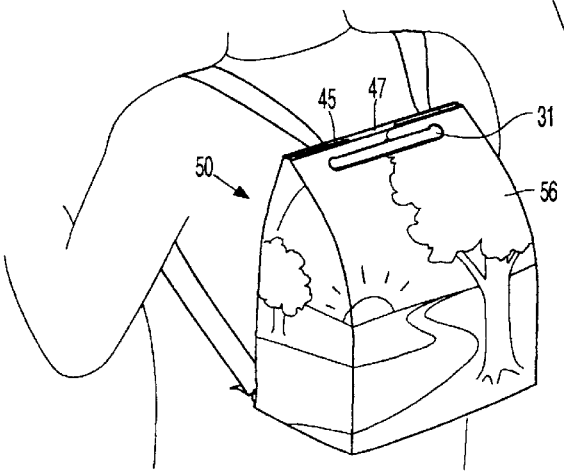
FIG. 7 shows a front perspective view of a filled flat bottom backsack in use, demonstrating how a printed picture can cover the entire bag in accordance with the invention.
Figure 8:
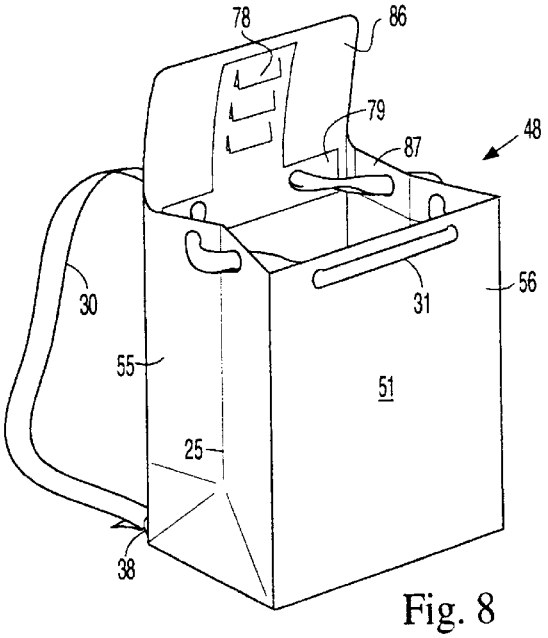
FIG. 8 shows a front perspective view of an open flat bottom backsack with an integral foul weather flap in accordance with the invention.

Bag 51 (FIG. 1*a*) comprises rear panel 54, and side gusset panels 55. FIGS. 7 and 8 (and FIGS. 9, 10, 11, and 11*a*) show front panel 56. FIG. 4*g* shows bottom panel 52, and bag 51 folded flat, the form it advantageously takes in its manufacture. FIGS. 1*a*, 8, and 11 show fold lines 25 along which bag 51 is folded when flat, as in FIG. 4*g*.

Bag 51 (FIGS. 1*a* and 4*g*) is advantageously made, by machine or by hand, of a single rectangular sheet of material that is first formed into a four-walled tube (not shown). A vertical glued seam holds it together (also not shown).

The preferred embodiment of the present backsack makes use of bottom panel 52 (FIG. 4*g*) for the purpose of strap 30 attachment to bag 51. Specifically, bottom flap 21 and bottom underflaps 23 together form pockets 22.

How the bottom corner pockets are utilized—FIGS. 3, 4*a*, 4*b*, 4*c*, 4*d*, 4*e*. 4*f*, 2, 2', and 13.

Figure 3:
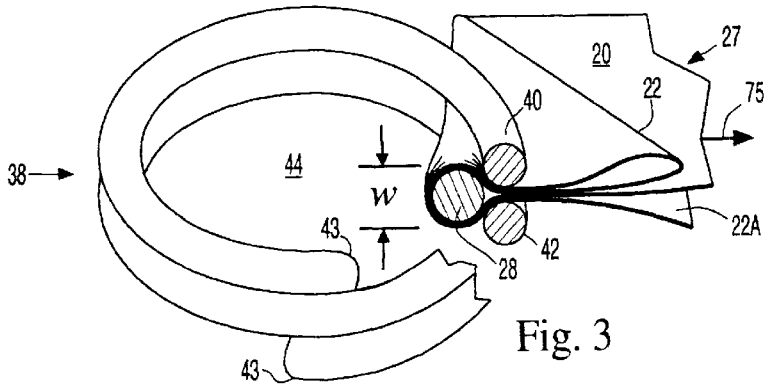
Figure 4A:
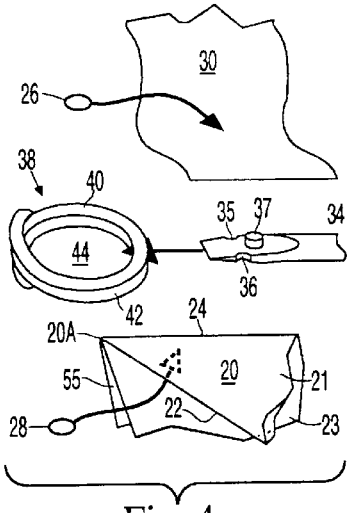
Figure 4B:
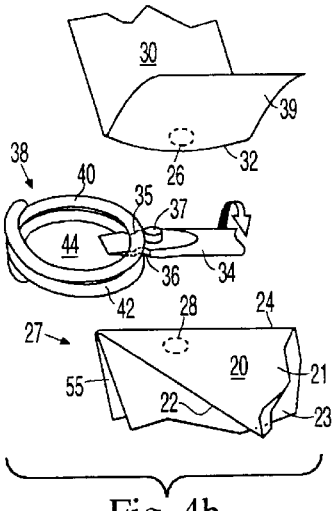

FIG. 4*a* shows how pocket 22 is advantageously deep, reaching all the way to rear bottom fold 24. This is clearly seen by the arrow leading from pellet 28 into pocket 22, its entrance into pocket 22 being indicated by the broken line arrowhead. Pocket 22 is also advantageously strong, since it comprises two folded layers 27 of the bag material (FIGS. 2 and 2'), which is one reason why this is the preferred bag embodiment. As the arrow indicates (FIG. 4*a*), pellet 28 is inserted into pocket 22 approximately ½ to ¾" (1.25 to 2 cm) from corner tip 20A, along bottom fold 24. In that position it serves as a gripping object for spring clip 38 (FIG. 3), or spring clip 66 (FIG. 2), either of which can grip strap 30, thereby attaching it to bag corner 20. The sequential FIGS. 4*a*, 4*b*, 4*c*, 4*d*, 4*e*, and 4*f* show how this is done (and is described in greater detail in the Assembly section, below). Combination clip 65 (FIG. 13) can also be attached to bag corner 20 in the same manner.

Alternative pocket folds—FIG. 12.

FIG. 12 shows a breakaway cross-section of flat-wire spring clip 66 and pellet 28 trapped within the interior 22A of a bag that has no exterior pocket folds. However, this embodiment has half the strength of the one above, since there is only one layer of bag material (27A) to grip along with the pellet contained within.

The bag top—FIG. 1*a*.

The top of bag 51 (FIG. 1*a*) is folded inward at edge 85 to form interior cuff 87. Strips of an appropriate material (not shown) are affixed under cuff 87 (also shown in FIGS. 6 and 8) to reinforce cuff 87 prior to punching holes 88.

The bag materials.

Bag 51 requires the use of sheet materials that are much stronger than the papers usually used for shopping or gift bags, but nevertheless can be printed and converted like paper. One such material is spun-bonded olefin, sold under the trademark Tyvek® (Type 10) by DuPont of Wilmington, Del. This is one of the suitable materials because of its strength it is capable of stretching 30-percent when stressed—rather than tearing—and gets even stronger in that condition.

Another such material is Yupo® made by Yupo Corp. of Chesapeake, Va., subsidiary of Oji-Yuka Synthetic Paper Corp. of Japan. Yet another material is Polyart®, distributed by Aijobex America. The latter two materials have smoother printing surfaces, and are therefore the preferred materials in certain applications. All are suitable because they are biaxially oriented; they are equally strong in any direction that they may be stressed.

Figure 6:
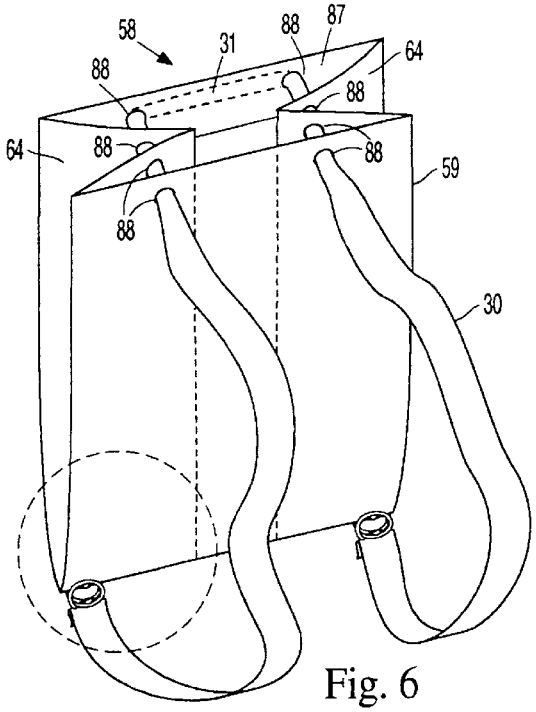
Figure 6A:
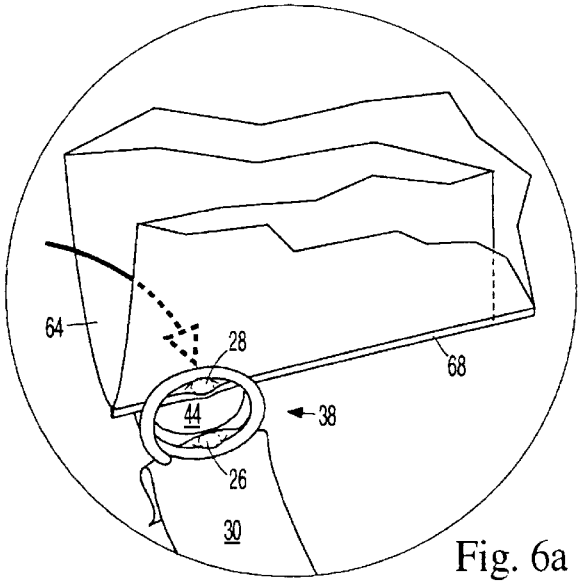
Figure 6B:
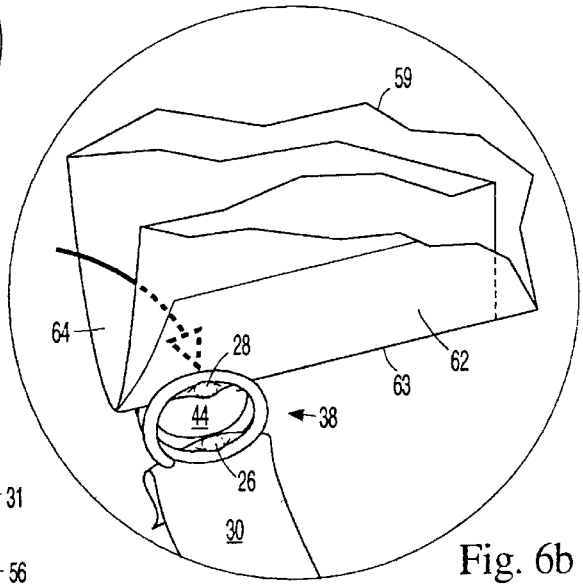

Pinch-bottom bags—FIGS. 6, 6*a*, 6*b*.

FIGS. 6. 6*a*, and 6*b* show how the same use can be made of pinch-bottom bag 59 by utilizing its gusset 64 in the same manner that pockets 22 of FIG. 4*g* are utilized. However, the construction of bag 51 is preferred for its flat bottom 52 (FIG. 4*g*), which provides a roomier bag that can stand up unsupported, and advantageously presents pockets 22, as will be described below.

Pinch-bottom bag 59 of FIG. 6*a* can be made by a widely used blown-film extrusion technique whereby gusseted rolls of polyethylene are simultaneously heat-sealed and cut into bags at intervals. Gusset 64 and heat seal 68 form a pocket (arrow) for insertion of pellet 28, which is hidden from view inside the pocket, but appears as a bump. A film thickness of 6 or 7 mils (0.152 or 0.178 mm) is required for strength. Cuff 87 (FIG. 6) can he formed and reinforced using existing heat-seal or hot-melt adhesive techniques.

FIG. 6*b* shows how the same bag style can be made of sheet materials, whereby glue flap 62 forms bottom edge 63 which, together with gusset 64, also forms a pocket suitable for pellet insertion (arrow). Here, too, the pellet is hidden from view inside the pocket, but appears as a bump.

Foul weather protection—FIGS. 8, 9, 10, 11, 11*a*.

FIGS. 8, 9, 10, 11, and 11*a* show four different foul weather protection configurations. FIG. 8 shows flap 86 with closure tabs 78, which tuck underneath crossover strap 31 to hold flap 86 closed when in use (not shown). Closure tabs 78 are integrated with reinforcement strip 79 insofar as both require a suitable material of some stiffness. Flap 86 can be integral (as shown), or auxiliary (not shown).

Figure 9:
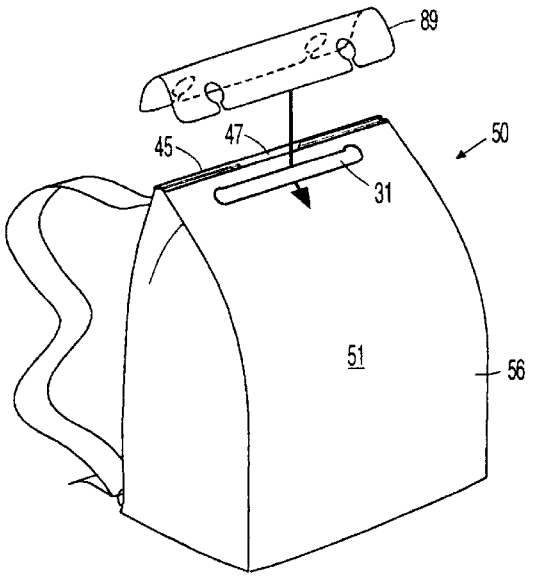
FIG. 9 shows a front perspective view of a filled flat bottom backsack with an auxiliary foul weather flap in ready-to-attach position in accordance with the invention.

FIG. 9 shows auxiliary foul weather protector 89 above backsack assembly 50.

Figure 10:
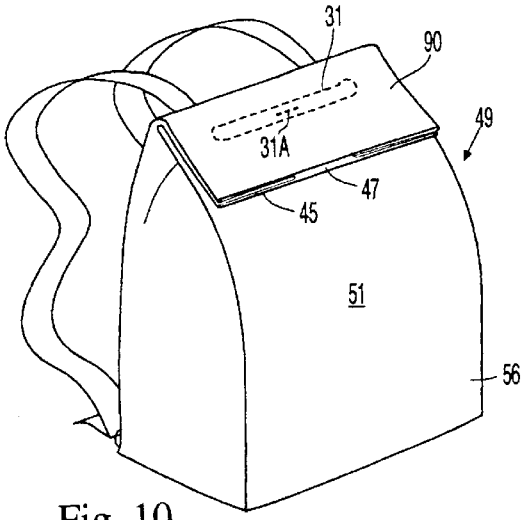
FIG. 10 shows a front perspective view of a long neck version of a flat bottom backsack with its extended neck folded down serving as an integral foul weather flap in accordance with the invention.

FIG. 10 shows long neck backsack assembly 49 with its upper portion 90 folded down and in use as a foul weather protector.

FIG. 11 shows open long neck backsack assembly 49 with tin-tie tabs 91 affixed to the top of its rear panel 54. The bag is shown open and unfilled, and the tabs are unused.

FIG. 11*a* shows long neck backsack assembly 49 in use with its upper portion rolled up 92, and tin-tie tabs 91 of FIG. 11 bent back 180-degrees to keep the roll 92 from unraveling.

Bag sizes and proportions—FIGS 1*a*, 6, and 7.

Bag dimensions can vary, but are determined largely by the size limitations imposed by available materials, printing, and bag-making equipment (the latter not being a factor when bags are made by hand). Although waste-avoidance is always desirable, it is especially so with the relatively expensive materials indicated above, so matching the desired bag dimensions to a particular machine's capabilities is important.

As for proportions, it is desirable to have the leftmost set of holes 88 to be as close as possible to the rightmost set of holes 88. Otherwise, shoulder straps can unintentionally "slip" off a wearers shoulder as they walk, particularly if the contents of the backsack is lightweight, or the wearer is small relative to the bag size, or has narrow or sloping shoulders. When the bag is collapsed prior to hole punching, the proximity of the leftmost holes 88 to the rightmost holes 88 is determined by the depth of side gussets 55 relative to the width of the back panel 51. This can be seen clearly in FIG. 6 (top). The greater the dimension of left and right gussets 64, the closer the leftmost set of holes 88 can be punched to the rightmost set of holes 88 (and the shorter crossover strap portion 31 will be). Accordingly, the gusset dimension should be only slightly less than the width of the bag. For example, if the bag width is 10" (25.4 cm), and the gusset is 7" (17.7 cm), the remaining slit 47 (FIG. 7) between the folded gussets is 3" (7.6 cm). This permits the holes to be punched approximately 4" (10.2 cm) apart.

The Clips

The clips 38 (FIG. 3) and 66 (FIG. 2) are basically extension springs whose coils are in contact with each other and resist separation, which requires a tool. They are shown round here, however they can advantageously have sets of straight portions (41), as in FIGS. 1*d*, 1*e*, 13 and 13A. When necessary, they can have two sets of straight portions (not shown)—one set on the strap side, as described, and another on the bag side—to accomodate elongated pellets in the bag pockets (not shown), or three straight portions, as in FIG. 13.

Figure 2:
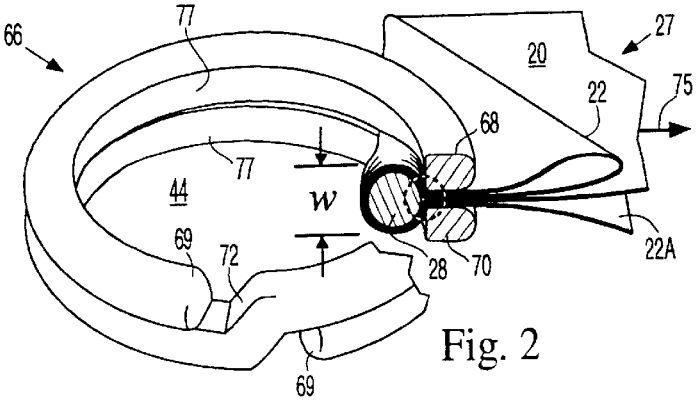
Figure 2:
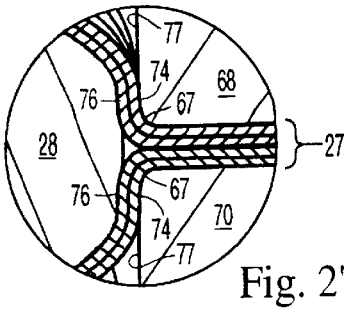

The flat-wire, Z-type split ring spring clip—FIGS. 2, 2', and 3.

FIG. 2 shows a front perspective view of flat-wire, Z-type split ring spring clip 66, the preferred embodiment. It resembles a key ring, but is much more powerful. The breakaway shows a cross-section of pellet 28 trapped inside pocket 22 of bag corner 20 (collectively, corner assembly 27). Arrow 75 represents tensile force pulling bag corner 20 to the right. (Opposing force provided by attached strap 30 not shown.) FIG. 2' shows a detail of gripper edges 67 of coils 68 and 70, with interior horizontally curved, vertically straight surfaces 77, and flat surfaces 76 on pellet 28, the portions flattened by tensile force 75 (FIG. 2) pressing pellet 28 against vertically straight surfaces 77.

Gripper edges 67 require a radius small enough to cause flattening of the bag material 74 and 76 to occur under the stress of tensile force 75, but not so small that it penetrates the material.

A suitable spring clip is made of 0.100" gauge (2.54 mm) steel wire and has a ⅞" (2.23 cm) outside diameter. Clips that work somewhat, but do not have the ideal cross-section, are available from Worth Manufacturing of Stevens Point, Wis. Appropriate thickness dimensions of pellets 26 (not shown) and 28 must take into account the bag (or strap) material thicknesses surrounding it, the sum of which (dimension w) can not be greater than dimension x of FIG. 2*c*.

The special spring clip opening tool—FIGS. 2*a*, 2*b*, 2*c*, and 4*c*.

Figure 2A:
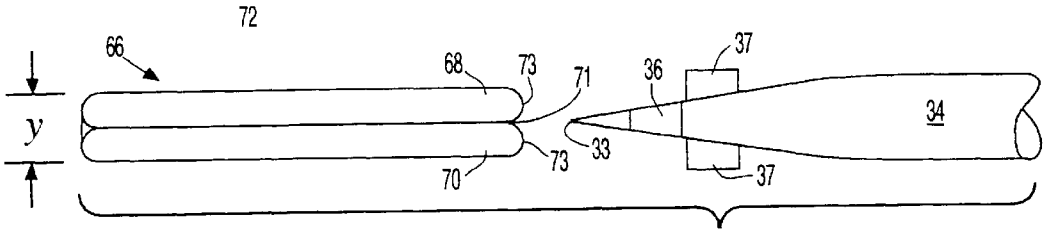

FIG. 2*a* shows a side elevation of flat-wire spring clip 66 and spring clip opening tool 34 with its tip 33 poised for entry into groove 71 located between coils 68 and 70, and defined by half-round perimeters 73.

Figure 2B:
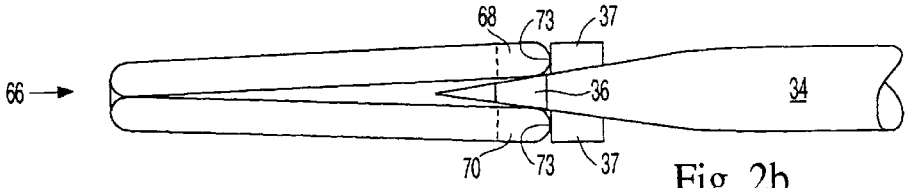

FIG. 2*b* shows a side elevation of spring clip opening tool 34 between, and slightly separating coils 68 and 70 of flat-wire spring clip 66, with spring clip opening tool stop 37 contacting half-round perimeters 73 of clip 66.

Figure 2C:
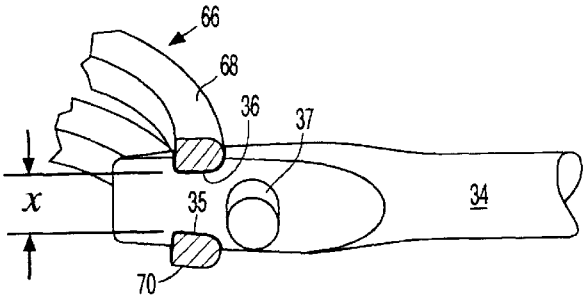
Figure 4C:
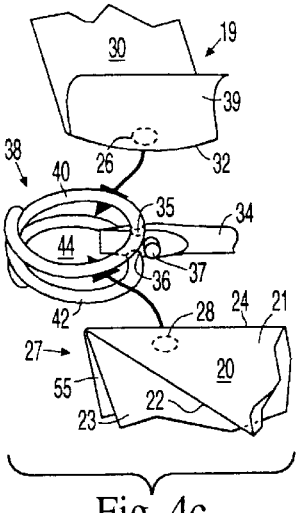

FIG. 2*c* shows a front perspective view of coils 68 and 70 of flat-wire spring clip 66 engaged by notches 35 and 36 of tool 34 fully separating them by a dimension x. This dimension must not be less than dimension w of FIG. 2 and FIG. 3, or corner assembly 27—which includes pellet 28—will not fit between coils 68 and 70 of flat-wire spring clip 66 (FIG. 2*c*), or coils 40 and 42 of round wire spring clip 38 (FIG. 4*c*). The same holds true for assembly 19 (pellet 26 within strap 30).

The special tool 34 is to be used by assembly workers to safely and rapidly attach the spring clips to the bags and straps in the manner indicated.

An alternative cinch-type combination flat-wire, Z-type spring clip—FIG. 13, and 13*a*.

FIG. 13 shows alternative combination spring clip 65. This clip combines the gripping features of the preferred flat-wire, Z-type clip (right side) with a cinch-type strap attachment 70A (left side), making it unnecessary to use a special tool to adjust the strap length. Tool 34 is still needed for attaching the right side to bag corner 20. Although straight portions at 70A are pressing against each other, most of the gripping force is caused by the cinch action of coil 68 and 70 when strap 30 is threaded in-between as shown, and when tensile force 75A pulls strap 30 to the left (arrow). The more tensile force, the more gripping power. This clip type can have other shapes, such as the half-round shape seen in FIG. 13*a*.

Commonly available strap adjustment clip opening tools for end-users—FIG. 13.

The coils of the left corners of clip 65 can be manufactured to be bent apart slightly (not shown) to facilitate the use of a common object, such as a US 25-cent coin (34A), or the edge of a key handle to pry apart coils 68 and 70 of combination clip 65 at which the strap 30 is attached by a cinch-type grip 70A. One such object inserted into each side of the clip (only one shown), separate the coils sufficiently to loosen the strap for length adjustment.

The round wire spring clip—FIG. 3 and FIG. 2.

FIG. 3 shows a front perspective view of round wire spring clip 38 with a breakaway cross-section of pellet 28 trapped inside pocket 22 of bag corner 20 (collectively, corner and pellet assembly 27) by coils 40 and 42. Arrow 75 represents tensile force pulling bag corner 20 to the right.

Flat-wire split ring spring clip 66 of FIG. 2 is preferred over round wire spring clip 38 of FIG. 3 for the following reasons:

(1) (tripper edges 67 in FIG. 2' have a smaller radius than coils 40 and 42 of round wire spring clip 38 (FIG. 3). Therefore, they provide a better grip on pellet 28 and prevent its escape from between coils 68 and 70 when tensile force 75 is high.

Figure 3A:
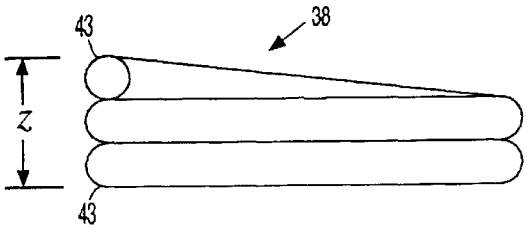

(2) flat-wire spring clip 66 is almost half the thickness (dimension y of side elevation FIG. 2*a*) of round wire spring clip 38 (dimension Z of side elevation (FIG. 3*a*) for a corresponding amount of initial spring tension. Flatness is important when stacking backsack assembly 46 (FIG. 4*g*) for storage and sale.

(3) Round wire coil ends 43 (FIGS. 3 and 3*a*) require tumbling in a coarse medium to dull the sharpness produced by the machine cutting of the spring wire. Even the dulled ends will dig in to adjacent bags when stacked for storage or sale, possibly disfiguring them. Cut ends 69 of flat-wire spring clip (FIG. 2), on the other hand, are safely tucked into the space defined by Z portion 72. Dimension y (FIG. 2*a*) should be no greater than the thickest part (not shown) of flat backsack assembly 46 (FIG. 4*g*), making a more uniformly thin package.

However, simpler round wire spring clip 38 (FIG. 3) has one advantage over flat-wire spring clips (FIGS. 2 and 13): The necessary anti-corrosion plating will cover virtually the entire surface of the steel wire since the coils are round and are only in tangential contact with each other. With flat-wire, Z-type spring clips, on the other hand, no protective plating can reach the flat surfaces that are in contact with each other, leaving them vulnerable to corrosion. This problem can be avoided by using pre-plated steel wire to make the clips, provided its protection remains intact throughout the manufacturing process. However, the clips must then be replated to protect the cut ends 69 (FIG. 2), and compensate for any loss of plating from the tumbling operation, which precedes plating, and is necessary to smooth the rough-cut ends. All of this adds to the cost.

A fourth alternative spring clip (not shown, but worth mentioning) is a helically wound flat-wire spring clip without the Z portion 72. Although it is flatter than a round wire spring clip and provides the superior grip of the Z-type clip, it does not provide all of its space-saving advantages, yet it also requires special tooling to produce.

Backpacks are normally handled very roughly. The snatching of fully loaded backpacks by one strap in order to sling them onto one's shoulders creates enormous stress where the strap meets the bag. The designated spring clips are up to this task.

The spring materials.

Accordingly, they should be made of carbon steel wire of a gauge and coil size sufficient to prevent escape of the trapped pellet 28 given the real-life conditions that a hard-working backpack presents. The spring clips should be of such quality that the coils retain their full initial spring tension after the stress of assembly (FIGS. 2*c* and 4*c*). The ideal steel for spring making is music wire. However, 0.100" gauge (2.54 mm) round wire all-purpose grade carbon steel springs with a ⅞" (2.23 cm) outside diameter have proven adequate. The use of music wire, plus the superior grip of a flat-wire clip warrants a gauge reduction and/or size adjustment. Much of the quality of a spring is determined by the skill of the spring-maker.

Stainless steel is inferior to carbon steel for spring making. However, it requires no plating to resist corrosion, as carbon steel does, and will prove adequate as a flat-wire clip, provided the power of its coils is equal to carbon steel, and is not compromised by the stress of separation (FIGS. 2*c* and 4*c*).

The Pellets

Pellet shape—FIGS. 4*a*, 2, 2'.

FIG. 4*a* shows pellet 26 and 28, which are preferably round in girth and oblong, like tiny elongated footballs. With round clips this is the preferred shape for two reasons:

(1) It conforms to the interior horizontally curved, vertically straight surface 77 (FIGS. 2 and 2') of coils 68 and 70 of spring clip 66 (FIG. 2), which provides optimal contact, and purchase, on cooperating gripper edges 67 (FIG. 2'). An ideal pellet material is somewhat resilient so that flat surfaces 76 occur (FIG. 2') as a result of tensile force 75 (FIG. 2) pulling the resilient pellet against vertically straight interior surface 77 (FIG. 2'). Together, these straight vertical surfaces further optimize the pellet's purchase on cooperating gripper edges 67.

(2) Its length spreads the energy of tensile force 75 (FIG. 2) manifest at the bag material surrounding the pellet, thus preventing its penetration and escape through the material.

Accordingly, a lengthier, more rod-like pellet in combination with a clip having straight portions on the bag side (not shown) is desireable. It also has the advantage of preventing its penetration through coarse woven straps, which can occur under high tension with more spherically shaped pellets.

Pellet thickness can vary—FIGS. 4*c*, 2, 2*c*, 3.

If two layers of strap 30 (FIG. 4*c*) material are thicker (not shown) than four layers of bag material, then the thickness of pellet 26 must be less than the thickness of pellet 28 (not shown) to compensate for the difference. In other words, dimension w (FIG. 2 and 3) must be the same for bag corner pellet assembly 27 (FIG. 2 and 4*c*) as the corresponding dimension of assembly 19 (FIG. 4*c*), the sum thickness of strap 30, strap flap 39, and pellet 26, or it will not fit between coils 40 and 42 of round wire clip 38, or coils 68 and 70 of flat-wire clip 66 (FIG. 2*c*) when insertion is attempted (FIG. 4*c*). For example, in FIG. 2*c*, if dimension x, the distance between the coils, is given at 5 mm, and the bag material is 0.25 mm thick, four layers of the bag material (which pocket 22 comprises) equals 1 mm. Therefore, pellet 28, if necessary, can be as much as 4 mm thick. On the other hand, if each of the two layers of folded strap 30 comprising assembly 19 (FIG. 4*c*) is 1 mm thick (making a total of 2 mm), then the thickness of pellet 26 cannot exceed 3 mm.

Pellet materials and sources.

Useful, but not ideal ready-made pellets can he found at jewelry finishing materials suppliers, where they are sold as tumbling media. Others sources are bead suppliers. Many plastics are available, including thermoplastic elastomers (TPE), which are rubbery plastics that can be made into pellets by injection molding, or a process called underwater pelletizing, which produces an oval-like pellet, but uniformity of size and shape is important, and would be factors.

The Strap

Straps can be seen in all figures except 2, 2*a*, 2*b*, 2*c*, 3, and 3*a*. FIG. 1*a* shows a one-strap/two shoulder arrangement whereby strap 30 begins at one clip 38, passes through all eight holes 88 at the bag's top, and terminates at other clip 38. An alternative strap termination is seen in FIG. 13 as cinch-type attachment 70A. A one-shoulder/one-strap configuration can be seen in FIG. 15 and 15*a*, a rear view of the same bag without its wearer, showing the same trapped peg method of strap termination at the bag top as seen in FIG. 14*b*. With this method, the strap emerges through slots, wraps around either the portion between double slots, as in FIGS. 14 and 14*a*, or around a peg that is too wide to be pulled into a single slot, as in FIG. 14*b*. Either way, the strap re-enters the bag (through the same or other slot) where it is glued. This inside-outside-inside strap path causes the stress on the strap to be limited to the more desireable shear type stress, which is far superior and more reliable compared to what would otherwise be a peel stress, which is well-known to easily fail.

The FIG. 14 two-strap/two-shoulder configuration with slots has two advantages: It keeps the straps flat for shoulder comfort; and permits the combining of two strap colors on the same bag—a decoration advantage. Slots—instead of round holes—can also be used to keep straps flat in the one-strap/two-shoulder version of FIGS. 7, 8, 9, 10, and 11*a*, however the slots would have to be angled, as in FIG. 15. Angled slots keep the strap flat at crossover 31, however, they require much higher reinforcement strips (not shown), which adds greater height, some weight, and expense to the cost of manufacturing. This tradeoff may be acceptable in some applications when, for example, a deluxe grade bag is called for.

FIG. 14*c* shows another strap termination at the bag top with horizontal slot 88A and rivet 95.

The straps can be folded in half or thirds lengthwise (made narrower) at their middle and held that way by sewing or application of an adhesive (not shown) so crossover portion 31 has a neater appearance (FIGS. 7, 8, 9, 11, and 11*a*). Narrowing of strap 30 can extend somewhat further than the length of crossover portion 31, as in FIG. 6, but care must be taken that it does not reach those portions of strap 30 that come into contact with shoulders when the bag is closed and being worn (FIG. 7), which would hurt the wearer. Crossover portion 31 of strap 30 (narrowed or not) can be affixed to the reinforced bag top (FIGS. 10, 11, and 11*a*) with a staple 31A, or other means. This will prevent bag 51 from sliding laterally along strap 30 in the event that bag 51 has weighty contents, and bag assembly 48 is picked up by only one of its shoulder loops (strap 30).

Waist straps—FIGS. 5*a*, 5*b*, 5*c*, 7.

FIG. 5*b* shows another one-strap arrangement whereby extra long strap 81 passes through holes 88 (only two shown), crosses over 31 at the top of front panel 56 (FIG. 7), passes through both clips 38 interiors 44 and, in use, continues around the wearer's waist (not shown), terminating at an adjustable buckle 83. Before being buckled, strap 81 advantageously forms extra large loops (broken line 81A) for easy mounting of the backsack.

FIG. 5*c* shows a variation of 5*b* whereby strap 81 begins at one clip 38, passes through holes 88 (not shown), and passes through interior space 44 of the other clip 38. The waist strap formed thereby terminates with adjustable hook 84, which attaches to clip 38 in use.

Figure 5A:
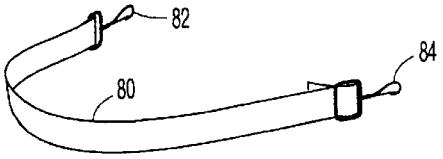
Figure 5C:
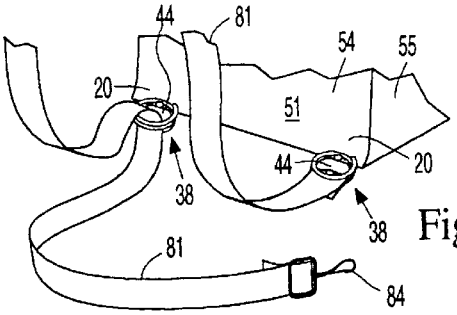
Figure 5B:
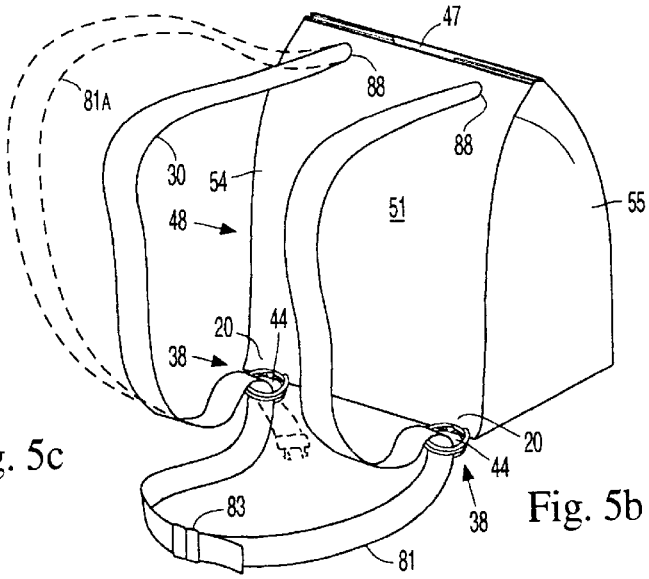

FIG. 5*a* shows auxiliary waist strap 80 with fixed hook 82 at one end, and adjustable hook 84 at the other end, each of which attaches to its respective clip 38 (FIG. 1*a*) in use.

Strap materials.

Polypropylene (PP) webbing is the preferred strap material, mainly for aesthetic reasons. However, straps can be extruded, or plastic rolled sheet slit into tape, or collapsed tubes of a suitably strong and flexible material. PP webbing must be cut with heat or its ends will unravel. Suitable strap dimensions for an adult wearing a backsack are 1" (2.54 cm) width, by 0.035" (1 mm) thickness, by 6 feet (182 cm) total length. Strap length varies slightly according to the size bag being used. Smaller backsacks, such as children would wear, require slightly shorter and narrower straps—¾" (19 mm) width by 56" (142 cm), for example, and preferably adjustable. It is best to avoid the combination of a spherical pellet and a coarse weave strap since the pellet can escape from between its woven threads under stress.

Assembly

Strap attachment at the bag top—FIGS. 1*a*, 4*g*, 10, 11, 11*a*, 14, 14*a*, 14*b*, 14*c*, 15, and 15*a*.

Actual strap attachment to bag 51 begins at the bag top. After cuffs 87 (FIG. 1*a*) are turned and reinforced, bag 51 is recollapsed, as in FIG. 4*g*, and—advantageously—remains so until the end user opens it. All eight holes 88 are then punched simultaneously with a tandem punch, and the straps are threaded through. As for round hole size, the holes are too small if straps bind when opening and closing the bag, and too large if the bag slides unduly on the straps in use. If straps are affixed to the bag top at crossover portion 31, such as with staple 31A (FIG. 10, 11, 11A), hole size can be increased for ease of opening and closing the bag top. Oblong holes (slots), as in 88A, 88B, or 88C provide superior ease of strap movement.

Strap attachment at the bag bottom—FIGS. 1*c*, 1*d*, 1*e*, 2*a*, 2*b*, 2*c*, 4*a*, 4*b*, 4*c*, 4*d*, 4*e*, 4*f*, 6*a*, 6*b*, and 13.

Figure 4D:
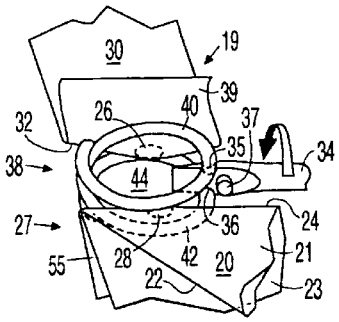
Figure 4E:
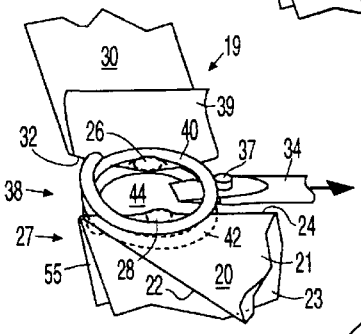

FIGS. 4*a*, 4*b*, 4*c*, 4*d*, 4*e*, and 4*f* show sequentially how strap ends attach at the bottom when the pellet method is used for both the strap-to-clip connection and the clip-to-bag connection—the preferred embodiment. At corner 20, with a suitable tool, such as tweezers (not shown), pellet 28 is inserted into pocket 22 as far as possible to rear edge fold 24 and deposited. Pellet 26 is placed near the end of strap 30. Once the pellets are in place, spring opening tool 34 is inserted between coils 40 and 42 of spring clip 38 as far as stop 37 permits. This aligns notches 35 and 36 with coils 40 and 42. Tool 34 is then rotated ¼ turn (90-degrees), engaging coils 40 and 42 in notches 35 and 36, and separating them a fixed distance. Then, strap and pellet assembly 19, and bag corner assembly 27, are inserted (arrows) between the separated coils 40 and 42 until pellets 26 and 28, respectively, are within interior space 44 of clip 38 (FIG. 4*d*). Tool 34 is then rotated back ¼ turn and withdrawn (FIG. 4*e*) to trap pellets 26 and 28 between coils 40 and 42, and within space 44 of clip 38, along with the respective bag and strap in which they are enclosed. Tool 34 also works well with flat-wire type clips (FIG. 2*c*).

FIGS. 6*a*, showing heat-sealed plastic edge 68, and FIG. 6*b*, showing glue flap 62, indicate how these two well-known types of pinch-bottom bags 59 also present the opportunity to attach straps by placing pellets within their gussets 64 (arrows).

Whatever the bag type, if more user-friendly strap length adjustment is desired, alternative combination clip 65 (FIG. 13) is the preferred clip, and should be attached to bag corners 20 also using tool 34 (FIGS. 2*a*, 2*b*, and 2*c*) for its attachment. However, for easier strap length adjustment, the edges of coins 34A (only one shown), such as a US quarter dollar, or key handles, or the like, should be temporarily slid between the coils 68 and 70, one at each side of the clip (not shown) to separate them sufficiently to loosen the strap (70A), enabling it to be adjusted in length.

The above sequence is intended to describe the inventive concept, not the actual product assembly sequence, which may vary. For example, some bag makers reinforce the bag tops first, before the bag itself is formed, while the bag material is flat. Or, to save time, a step, such as pellet placement, is repeated by an assembly worker, in assembly-line fashion.

The pellet (stitchless) method of attaching clips to bags is absolutely essential, since all other methods—such as sewing or grommeting—are destructive, in that they require penetration of the bag material with the resultant weakness and failure of the material under stress. However, since most strap materials can be sewn and grommeted without risk of failure, the pellet method, although effective and convenient, is not essential. Accordingly, when circumstances dictate, straps can be attached to clips by methods other than the pellet. The conventional sewn loop connection of FIG. 1*d*, the double folded and sewn strap end bead of FIG. 1*e*, and the strap-penetrating rivet of FIG. 1*c* are examples of such alternative methods.

Operation

Fine printing and high strength—FIG. 7.

Unlike the woven fabrics used in conventional backpacks, the materials used for the backsack of the invention can be printed using the best printing methods available, which produce quality images comparable to those, for example, seen on the box packages of the major dry cereal companies, or the pages of slick magazines. For the first time, whoever wishes to carry even heavy things on their backs—as much as approximately 22 pounds (10 kilograms) or more—can choose a backsack because of the picture or message printed on it (FIG. 7). Or, those who wish to publicly display graphics for promotional purposes, no matter how fancy or complex—including photographic images—can, for the first time, have produced and distribute backsacks of the invention that provide superior eye-level high-quality display of their message or image on the wearer's backs.

Repeated use and long life.

Moreover, because of its superior durability, wearers can use the backsack repeatedly, providing the promoter extremely valuable ongoing public display of their image or message indefinitely into the future—making every wearer a virtual walking billboard!

One reason why the backsack has superior durability is, unlike conventional low-cost backpacks, it is not sewn. Consequently, there are no stitches to weaken the bag material, which would cause it to tear at its seams. Another reason is, in many conventional low-cost backpacks, the straps have a peeling relationship with the bags to which they are sewn. That is, the bags pull in one direction, and the straps in another, putting an excessive strain on the few stitches that hold them together, particularly on the first stitch at the point of greatest stress, which soon fails, passing the burden to the next stitch, etc. On the other hand, since there is no such point of weakness in the present backsack, it lasts a long time.

Comfortable straps.

The longevity of the backsack of the invention would he meaningless if it were not also comfortable to wear. Flat straps make this comfort possible. By contrast, most conventional low-cost backpacks use their drawcords also as shoulder cords, which are painful on the wearer's shoulder when they attempt to carry contents weighing no more than only two or three pounds (1 to 1.5 kg).

Superior display—FIG. 7.

Once assembled and ready for use, the backsack, though collapsed, nevertheless clearly displays whatever has been printed on its entire front panel (not shown). This feature enhances the utility, hence commercial value, of the backsack, since an end-user can make a selection based on its highly visible graphics, whether or not the backsack is still in its transparent outer wrapper, such as a polyethylene hag. Then, when filled, even before—and especially while being worn, the backsack not only continues to provide full display of its back panel, but also displays almost all of whatever is printed on its side panels (FIG. 7), and continues to do so throughout its long life. Thus, the serious limitations of conventional low-cost backpacks have been overcome. There are no ugly bunched-up tops—such as there are with drawcord-type backpacks—that obscure whatever (limited) images they are capable of receiving when they are pulled closed. And the present backsack images are not limited to those that can be applied to woven fabrics, nor are image sizes limited to small, expensively reproduced sewn-in panels, as is the case with conventional backpacks.

Built-in low cost.

Furthermore, despite its superior features, the present backsack is inexpensive because it can be produced without sewing—both in large quantities, mainly on rapid, automatic equipment, and in smaller quantities, mainly by hand, the latter without the necessity and expense of making-ready the larger automatic equipment. Thus, another limitation of conventional backpacks has been overcome, since they can only be rapidly produced in large quantities by the employment of a great many relatively slower sewing-machine operators.

Easy to load—FIG. 1*a*.

The present backsack is easily loaded by opening it and standing it up on its flat bottom (FIG. 1*a*), in which position it advantageously remains—unsupported—while being loaded. Conventional low-cost cloth packpacks, on the other hand, usually have no flat bottoms on which to stand, and even those that do, such as the round-bottom duffle, or stuff-bag type (not shown), the bag walls remain collapsed while being filled, making it a clumsy endeavor.

Easy to close—FIGS. 1*a,* 6, 7, 9, 10, and 11*a*.

Closing the present backsack is straight-forward and intuitive. After loading is complete, to close the open top of the backsack, a user has merely to push (not shown) the top of rear panel 54 (FIG. 1*a*) towards the top of front panel 56 (FIG. 7) while withdrawing strap 30 out of, and away from each of the two holes 88 located at rear panel 54, resulting in a closed top, as seen in FIGS. 7, 9, 10, 11*a*, and 14. The present backsack induces the user to close the hag in order to wear it, since the shoulder loops are at their largest when the bag top is closed—which is their best condition for receiving the wearer's arms. Moreover, the present backsack tends to close itself by merely being put on one's back. It does this best when the weight of the bag contents is sufficient, and the friction of strap 30 sliding through holes 88 is relatively low, as it would be with slots 88A, 88B, and 88C. This is particularly true of the portions of strap 30 that come into contact with holes 88 when the bag top is near-closed, as seen in FIG. 6 (top). These strap portions are on both sides of and adjacent to strap crossover portion 31. Their friction through holes 88 can be reduced by folding them in half—or thirds—lengthwise (made narrower) and fixing them in that position along with crossover portion 31 (which can be narrowed for esthetic reasons). However, it is important that the narrowed portions do not reach any portions of strap 30 that come into contact with shoulders when the backsack of the invention is worn, lest the strap 30 be painful to the wearer.

The above-described benefits of narrowing strap 30 by folding should be weighed against the resultant deficits of a slightly thicker backsack assembly and a slight additional cost of labor. Let the final application determine which is most desirable.

Strap length adjustment—FIGS. 2*c*, 4*c*, 4*d*, 4*e*, 4*f*, 13, and 13*a*.

Figure 4F:
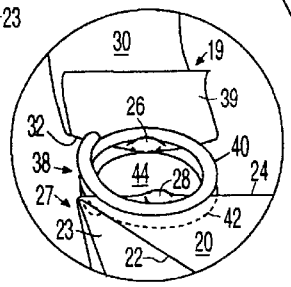
Figure 4G:
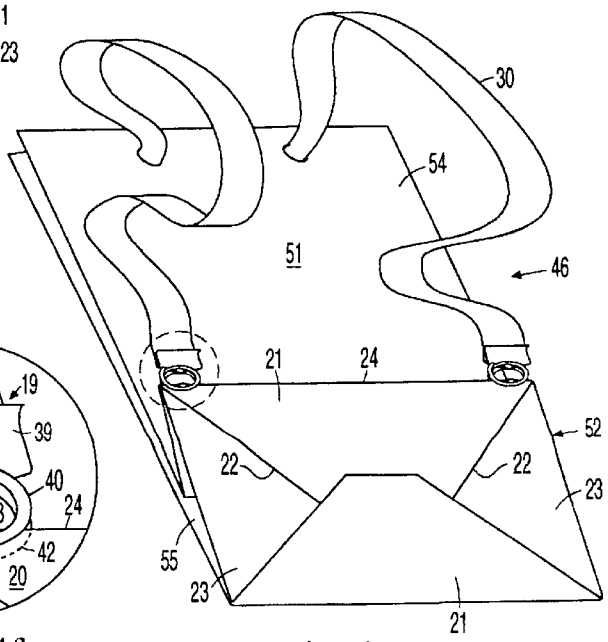

One way an end-user can adjust strap length is described by first reversing the action sequence of FIGS. 4*c* through 4*f*, and then un-reversing it, as follows: FIG. 4*f* is the starting point, since strap 30 is already attached to bag corner 20 by means of clip 38. Reversing the direction of the arrow in FIG. 4*e*, a small screwdriver (end-users would not have access to special spring opening tool 34) is inserted between the coils 40 and 42 (not withdrawn, as shown). Any ordinary screwdriver would not have the benefit of stop 37 of tool 34, so care must be taken not to insert the tip too far. The width of the screwdriver tip should be the same as dimension X of FIG. 2*c*. The screwdriver is then carefully rotated ¼-turn (90-degrees), as in FIG. 4*d*, separating coils 40 and 42. Neither would an ordinary screwdriver have notches 35 and 36 of tool 34 to safely engage coils 40 and 42. Spring clip 38 is extremely powerful, so great care must be taken to prevent clip 38 from dangerously springing off the screwdriver tip. Then, strap and pellet assembly 19 only—not corner assembly 27—is carefully withdrawn from between the separated coils 40 and 42 (FIG. 4*c*), pellet 26 is removed from fold 32 of strap assembly 19 and relocated into another fold made in strap 30 according to the strap length desired, and strap and pellet assembly 19 is carefully reinserted within interior space 44 of clip 38 (FIG. 4*c*). The steps now un-reverse, that is, at this point the sequence reverts back to that of original assembly, so that once the (newly adjusted) strap assembly 19 is again within space 44 of clip 38, the screwdriver is rotated ¼-turn again (FIG. 4*d*) allowing it to close, and withdrawn (FIG. 4*e*), reconnecting the strap to the bag (FIG. 4*f*).

Another more user-friendly strap-length adjustment method is provided by alternative combination clip 65

(FIGS. 13, and 13*a*). It is attached to bag corner assembly 27 (right) according to the invention by assembly workers using tool 34 (FIGS. 2*a*, 2*b*, and 2*c*), or similar tool. However, its more easily adjustable part (left) operates as a cinch-type fastener, enabling end-users to easily adjust strap length. They can do this by using such commonly available objects as US quarter dollar coins 34A (only one shown), or key handles, one edge at each side of the clip, to temporarily separate coils 68 and 70 enough to loosen the strap 70A, enabling it to be adjusted. After strap adjustment, removing the coin (or key) edges from between the coils returns the strap side of the clip to its usual cinch-type function. Any clip shape, such as the half-round of FIG. 13*a*, is suitable for this technique.

Choice of waist straps—FIGS. 1*a*, 1*b*, 5*a*, 5*b*, and 5*c*.

Users of the present backsack can have a waist strap by attaching auxiliary strap 80 with fixed hook 82 and adjustable hook 84 at its ends (FIG. 5*a*), which advantageously hook into (not shown) open space 44 of spring clip 38 (FIG. 1*b*), or of alternative combination clip 65 (FIG. 13), located at bottom corners 20 on both sides of rear panel 54 (FIG. 1*a*). Although it can be made available as an accessory, in its absence, a do-it-yourself waistband can be easily fashioned out of a length of cord or ribbon (not shown) by tying it to both clips 38 through open spaces 44.

An integral front-buckling waist strap (FIG. 5*b*) can be had with only an extra-long strap 81, which passes through spring clips 38 (or combination clips 65, of FIG. 13), and terminates at buckle 83. This configuration provides the easiest mounting of the backsack onto one's back because it provides the largest shoulder loops. Such loops occur before the strap ends are buckled together, when the strap portions adjacent to the buckle are short (or nonexistent), when most (or all) of the extra length of strap 81 is still above spring clips 38 (broken line 81A), and added to the normal shoulder loops. If a two-part buckle is used (recommended), each buckle part serves as a stop that prevents the ends (waist portions) of the strap from pulling out of their respective spring clips as the largest possible shoulder loops are formed. Mounting the backsack onto one's back in this configuration requires the mere turning of one's back to the loaded bag, draping the respective straps over one's shoulders, pulling the two buckle parts towards each other around one's waist, and snapping them together. This pulling not only closes the bag, but lifts it to carrying height on one's back. Of course, the closer to carrying height the loaded bag is to begin with, the less lifting is required. This is the recommended configuration and procedure for those users—the elderly for example—who have difficulty swinging fixed-loop size backpacks onto their backs because of the twisting, rearward-bending arm movements it requires, and do not have use of a waist strap, since low-cost backpacks neither provide them, nor provide a convenient way to attach do-it-yourself versions.

The side-connecting hook waist strap configuration of FIG. 5*c* has one advantage over that of FIG. 5*b*: the hardware is off to the side, where it does not touch the wearer's body, as the centered buckle does. Some users prefer this. However, since the configuration is not symmetrical, the easy-on technique described above works only on the side opposite to where the hook attaches.

Choice of foul weather protections—FIGS. 5*b*, 7, 8, 9, 10, 11, 11A, and 14.

Although the backsack in its standard embodiment—when fully closed as in FIG. 7—provides some protection against inclement weather, more protection may be desired, since closed top edge 45 (FIGS. 5*b*, 7, 9, and 14), particularly remaining slit 47, are not sealed.

Auxiliary foul weather protector 89 of FIG. 9 solves this problem, but requires a fully closed, or near-fully closed bag top to fit properly. It is the only one of the four different foul weather protection configurations shown requiring that. However, among those shown, it is the only one suitable for use with the standard embodiment of the backsack (FIG. 7 and 9). All others require some bag modification, which costs more.

FIG. 8 shows integral flap 86 with closure tabs 78. They tuck beneath crossover strap 31 (from the bottom up) to hold flap 86 closed when in use (not shown). Closure tabs 78 can be integrated with reinforcement strip 79 insofar as both require some stiffness. The number of closure tabs 78 determines the increments the bag top opening can he adjusted to, in the event the bag is overfilled and cannot be closed completely. Flap 86 can also be auxiliary (not shown), making it an adjustable alternative to foul weather protector 89 of FIG. 9, and also suitable for use with the standard embodiment of the backsack of the invention (FIG. 7 and 9).

The remaining foul weather protection embodiments require extended upper portions (long necks) above the strap holes:

FIG. 10 shows long neck backsack assembly 49 with its upper portion 90 folded down and in use, providing the most foul weather protection of all embodiments, since unsealed closed top edge 45 faces down, and upper portion 90 entirely covers crossover strap portion 31, whose holes would otherwise permit entrance of some water, especially under the most severe weather conditions. However, protection can be compromised by strong winds and overfilling the bag, unless some additional hold-down means is employed (not shown). Also, the uninterrupted character of the display area is compromised.

FIG. 11 shows the remaining long neck backsack version with so-called "tin-tie" tabs 91 commonly used for the retail packaging of freshly ground coffee affixed to the top of rear panel 54. These tabs are hand-bendable, and remain in whatever position they are bent into. The bag assembly 49 is shown open and unfilled, and the tabs unused.

In FIG. 11*a*, the tin-tie version of long-neck backsack assembly 49 is in use, with its long neck rolled up 92. Both ends of tin-tie tabs 91 (only one visible) are bent back 180-degrees to keep the roll from unraveling. This embodiment provides positive mechanical closure, an uninterrupted display area, and the rolled up neck 92 makes a convenient handle. However, strap crossover portion 31 is still somewhat exposed to inclement weather.

Conclusion, Ramifications, and Scope

Thus, it is clear that the present backsack provides low cost, one-compartment backsacks that;

- have large, uninterrupted wrap-around, high-quality printing surfaces that give superior eye-level visibility to graphics;
- can be printed by a variety of methods;
- are sturdy and long-lasting because they are made with high-performance materials, without destructive penetration from sewing and grommeting;
- can stand up unsupported for loading and unloading;
- operate with flat straps that are adjustable, comfortable to wear, provide a waist strap option, and positive, neat closure;
- can be made by machine in large quantities, as well as by hand in smaller quantities;
- are produced in compact flat stock-keeping units.

Although the above description sets forth specific preferred embodiments of the invention, it should not be construed as limitations on its scope. Many variations are possible. For example, rather than making the entire bag of a costlier high-strength material, bags can be reinforced only at points of stress, thereby further reducing the cost of the backsack. Such reinforcement can be applied in liquid form, or one or two-sided pressure-sensitive tape, or glue patches, room temperature, or hot-melt, which can accompany, be attached to, or be integrated with the pellets. When convenient or necessary, pellets can be placed into folds within the interior of bags that have no exterior pocket folds (FIG. 12) to get a similar result, or attach straps at other exterior locations (but connections will be half as strong because pellets will be enclosed by one layer 27A, instead of two). Pellets can be placed—manually or automatically, with or without reinforcement—in their correct positions during the bag folding operation.

The pellets can be injected into their destination corner fold pockets 22 (FIG. 4*a*) at an appropriate time during assembly with a device that injects pellets.

Alternatively, the pellets can be made of a putty-like material placed with a metered-dose caulk gun. These will better conform to the shape of the space it occupies, thereby increasing its purchase on the interior gripping edges of the clip. Further benefit can be achieved by the timely curing of the pellet in its final shape into a hard, but resilient material.

The pellets can be square, or some other shape with a flat surface to optimize its grip even further, provided its flat surface can be reliably aligned with the interior surfaces of the spring clips. Or, the pellet can have an X-shaped cross-section whereby the legs of the X catch onto the interior surfaces providing purchase, no matter what its alignment.

Alternative combination cinch-type spring clip 65 (FIG. 13) can be made so that the straight portion cinch-type coils 68 and 70 (left), instead of being in hard contact with each other, thus requiring a tool to make a strap length adjustment, are made easier to separate with the fingers alone, so that nothing at all is needed to separate them for strap length adjustment. Moreover, although it has a neater appearance, it's not necessary for a cinch-type clip to have straight portions. In fact, traditional cinch-type fasteners are round. Round coil spring clips, such as clip 66 (FIG. 2) or clip 38 (FIG. 3) can also be made to have the same pre-separation of adjacent portions of their coils on one side, enabling them to behave as true cinch-type strap fasteners on that side, yet perform according to the present invention on the opposite side. In fact, pre-separated coils notwithstanding, a manufacturing tool to make entirely round spring clips costs significantly less than one that has straight portions. The clips can be trapezoidal, or square, to accommodate an elongated, or rod-like pellet on one or both sides.

Whether straight or round, the gripping portions can be stamped to be flatter than the rest of the clip to compensate for the two additional strap thicknesses that the cinch-type clip requires, thus keeping the flatness of the collapsed package uniform.

Each clip can be made, not of steel springs, but of two parts that snap together while grabbing the pellet, or held together with a fastener. It can be made of a rigid high-performance plastic, which has the advantages of corrosion resistance and self-decoration. Or, it can be a stamped metal type clip in which the grasping jaws are activated by a lever, similar to that used to hold children's mittens onto their sleeves, or suspenders onto trousers. They can be small spring-loaded electrical alligator, or blunt nose clips, modified to prevent penetration, that works reverse action (squeeze to open). It can be the keyhole-shaped type clips in which the pellet is wider than the narrow part of the keyhole. In this type of stitchless fastener, the pellet, together with the bag material, is pushed through the wide part and pulled into the narrow part, trapping the material.

The pellet can he a small cylinder with a coarse male helical thread—like the neck of a small bottle—and the clip is the female threaded "cap" which is screwed on to it with the bag material in between, trapping the material.

The clip can be, or incorporate, a two-part non-penetrating rivet in which the male part (the pellet equivalent) and the female part are concentrically aligned in a rivet-setting tool with the bag material in-between. The setting tool is then pounded, causing both parts to flatten, and the female part to partially surround and conform to the male part, crimping the material in-between. Or the clip can be integrated with the pellet. They are pushed onto the corner pocket from the side, and crimped or snapped together, their connecting member remaining, or removed after the connection is made.

Whatever the clip/pellet embodiments, they can be used for attachment elsewhere on bags besides the outside bottom corners, such as in the inside corners for attaching straps to bags that have no exterior folds or gussets (FIG. 12). Auxiliary or stand-alone straps or handles can be attached to the top edge of the bag by placing pellets under the turned top. Such attached clips will obviate the need for reinforcing and punching holes through the turntop. The clip can be large enough to be its own handle. Or pellets and clips can be placed anywhere inside bags for attachment of accessories, such as flashlights, or light reflectors for night-time hike riders, or other bags, to the outside of the bags, or to partition the bag interior. In this way, a second bag with the same girth can be attached by its turntop underneath the first bag, to make a "double-deck" backsack. Or they can be placed outside a bag, such as in a gusset, to attach accessories, or other smaller bags, such as a change purse, to the inside.

The stitchless, non-penetrating advantage of the spring clip and pellet method can be used to attach straps or cords to products made of flexible materials, woven or non-woven, that are too weak for attachment by sewing, thereby transforming ordinary bags such as laundry bags, stuff bags, etc. into backpacks.

A coil of the helical type spring clips (FIG. 3) can be extended by ¼ coil to provide a point of entry for a second coil separating tool to be used opposite the first. Two tools used simultaneously spread the coils uniformly, providing better access for bag and strap insertion.

Strap 30, instead of being folded lengthwise to make it narrower, can be woven to have variable width, so that the portion exposed at crossover portion 31, and a short distance beyond, is narrower than the rest of the strap, giving it a neater appearance, and reducing friction when opening and closing the bag.

As a strap length adjustment alternative, strap 30 can have the hooks and loops (Velcro) type fastener near its ends. The strap would wrap around the clip the same as in FIG. 1*d*, but the Velcro would replace the permanent sewing 61 shown. Or, the Velcro itself could wrap around the clip.

The auxiliary foul weather protector 89 depicted in FIG. 9 can be made integral to the bag and without the need for extra material by leaving rear cuff 87 (not shown) unglued, cutting slits at the corners where it meets the side gusset cuffs, and cutting slits from its holes to their adjacent edge (similar to those shown in 89). This allows it to be folded up and out of the bag to cover the opening in the event of inclement weather, just as auxiliary foul weather protector 89 does.

Accordingly, the scope of the invention should be determined not by the embodiments presented herein, but by the appended claims and their legal equivalents.

I claim:

1. A backsack, comprising in combination:

a bag having an openable bag upper portion and a closed bag lower portion, said closed bag lower portion having at least one folded area, at least one strap having at least one strap upper portion and at least one strap lower portion, said at least one strap upper portion being attached to said bag upper portion, a grippable object positioned in said at least one folded area of said bag lower portion, clip means for gripping said bag lower portion together with said grippable object and also being for securing said at least one strap lower portion thereto, whereby said at least one strap is connected to both said bag upper portion and to said closed bag lower portion.

2. The backsack in accordance with claim 1, further including another folded area of said bag lower portion, wherein said at least one strap upper portion being attached to said bag upper portion at a first location, extending from said first location to a second location of said bag upper portion to define a second strap upper portion attached to said second location, and extending to said bag lower portion to define another strap lower portion, said backsack further including another clip means for gripping said another folded area of said bag lower portion and for connecting said another strap lower portion thereto and further including another grippable object positioned in said another folded area of said bag lower portion for gripping by said another clip means, whereby said at least one strap is connected to said second location of said bag upper portion and to said another folded area of said bag lower portion.

3. The backsack in accordance with claim 1, wherein said clip means includes at least two integral spring members, said at least two spring members being moveable between a non-biased mode and a biased mode, said non-biased mode being when said two spring members are positioned in adjacent relationship and said biased mode being when portions of said two spring members are spaced apart, said at least two spring members defining an aperture.

4. The backsack in accordance with claim 3, wherein said grippable object within said folded area of said bag lower portion is positioned between adjacent portions of said at least two spring members and within said aperture.

5. The backsack in accordance with claim 4, wherein said clip means for securing said at least one strap lower portion includes said at least one strap lower portion having a strap fold forming two layers of said strap and defining an inner fold space with a closed fold end, and further including a grippable article positioned in said fold space at said closed fold end, said grippable article along with said two layers of said at least one strap lower portion being positioned between adjacent portions of said two spring members and within said aperture defined by said two spring members, whereby said at least one strap lower portion is secured to said bag lower portion by said grippable article and said spring members.

6. The backsack in accordance with claim 5, further including means for adjusting the length of said at least one strap between said at least one strap upper portion and said clip means, said means for adjusting including said inner fold space being a first inner fold space, said at least one strap lower portion being refoldable to define a second inner fold space distanced from said first inner fold space, said grippable article being repositioned within said second inner fold space, said grippable article within said second inner fold space of said at least one strap lower portion being repositioned between adjacent portions and within said aperture defined by said two spring members.

7. The backsack in accordance with claim 5, wherein said grippable article comprises a rivet, said rivet being connected to said at least one strap lower portion so as to provide at least one raised gripping edge, said at least one strap lower portion being positioned between adjacent portions of said two integral spring members with said rivet and said connected at least one strap lower portion being within said aperture defined by said two integral spring members, whereby said at least one strap lower portion is secured to said bag lower portion by said rivet and said clip means.

8. The backsack in accordance with claim 4, wherein said two spring members are two coils that define said aperture which is circular.

9. The backsack in accordance with claim 4, wherein said two spring members form at least one straight portion.

10. The backsack in accordance with claim 9, wherein said two spring members define an aperture which is D-shaped.

11. The backsack in accordance with claim 4, wherein said at least one strap lower portion forms at least one fold thereby forming a plurality of strap layers, said layers being fastened together so as to form a grippable raised strap end, said at least one strap lower portion being positioned between said adjacent portions of said integral spring members, and said raised strap end being positioned within said aperture thereby captivating said at least one strap lower portion, whereby said at least one strap lower portion is secured to said bag lower portion by said raised strap end and said clip means.

12. The backsack in accordance with claim 3, wherein said means for securing said at least one strap lower portion includes said at least one strap lower portion passing through said aperture of said at least two spring members and forming a closed loop around adjacent portions of said two integral spring members, said closed loop being fastened together at a location external to said clip means so that said two integral spring members of said clip means are captivated within said closed loop, whereby said at least one strap lower portion is secured to said bag lower portion by said clip means.

13. The backsack in accordance with claim 4, further including means for adjusting the length of said at least one strap between said at least one strap upper portion and said clip means, said means for adjusting including said at least one strap lower portion being threaded through said aperture, wrapped around one of said spring members, and wrapped about the other one of said spring members such that a portion of said at least one strap lower portion is adjustably cinched between said two spring members.

14. The backsack in accordance with claim 1, wherein said bag is folded to form side gussets, said closed bag lower portion having a bottom panel with a plurality of pockets, said pockets being located on the outside of said bottom panel and on the outside of said closed bag lower portion, at least one of said pockets having an inside area, said inside area of said at least one pocket being said folded area of said bag lower portion.

15. The backsack in accordance with claim 1, wherein said bag is folded to form side gussets, said closed bag lower portion being pinched so as to form a pinch-bottom bag, said side gussets together with said pinched bottom forming gusset pockets at least one of said gusset pockets having an inside area, said inside area being said folded area of said closed bag lower portion.

16. The backsack in accordance with claim 1, further including auxiliary means for affixing at least one portion of said at least one strap upper portion to at least one area of said bag upper portion whereby said at least one strap upper portion is prevented from moving in any direction relative to said at least one area of said bag upper portion.

17. The backsack in accordance with claim 14, wherein said two integral spring members form a split ring including two concentrically aligned parallel coils connected at a Z-shaped portion, said coils having opposed flat surfaces and interior straight surfaces in cross section thereby forming a junction, said junction forming opposed gripping edges.

18. The backsack in accordance with claim 1, wherein said bag is made of a single sheet of material.

19. The backsack in accordance with claim 2, wherein said bag upper portion includes an inwardly folded and reinforced bag top area defining a plurality of holes, a portion of said strap upper portion being threaded through said holes, whereby said strap is attached to said bag top area and said openable bag upper portion can be closed when in use.

20. The backsack in accordance with claim 1, wherein said grippable object is a pellet.

21. The backsack in accordance with claim 20, wherein said pellet is elongated.

22. The backsack in accordance with claim 2, further including an auxiliary waist strap secured to said clip means and said another clip means.

23. The backsack in accordance with claim 2, said another strap lower portion further extending from said another clip means to said first mentioned clip means so as to form an integral waist strap.

24. The backsack in accordance with claim 1, said bag upper portion including a long bag neck, said long bag neck being folded and turned in a downward direction on one side of said bag upper portion, whereby interior contents of said bag are protected.

25. The backsack in accordance with claim 24, wherein said long bag neck is rolled, and further including bendable strip means for preventing said rolled long bag neck of said bag from unrolling.

26. The backsack in accordance with claim 1, further including auxiliary means for protection of interior contents of said bag, wherein said means is a strip detachably affixed across said openable bag upper portion to cover said openable bag upper portion.

27. The backsack in accordance with claim 1, wherein said closed bag lower portion includes a plurality of interior areas, at least one of said interior areas being said folded area of said bag lower portion, at least one of said grippable objects being positioned in at least one of said interior areas, whereby said at least one strap lower portion is secured to said folded area of said bag lower portion by said clip means.

* * * * *

UNITED STATES PATENT AND TRADEMARK OFFICE

CERTIFICATE OF CORRECTION

PATENT NO. : 5,957,354

DATED : September 28, 1999

INVENTOR(S) : Mentken, Robert

It is certified that error appears in the above-identified patent and that said Letters Patent is hereby corrected as shown below:

| | |
|---|---|
| Abstract | Line 13, (begins with "serves as...") after "top," change "leach" to – Each –; |
| Column 1 | Line 61, after "attempt" insert —.—; |
| Column 7 | Line 65, after "strength" insert —;—; |
| Column 8 | Line 4, after "by" change "Aijobex" to —Arjobex—; |
| Column 10 | Line 38, after "(1)" change "(tripper" to —Gripper—; |
| Column15 | Line 35, change (first word) "hag" to —bag—; |
| Column 16 | Line 9, after "the" (second occurrence) change "hag" to —bag—; |
| Column 20 | Line 34, after "time" change "hike" to —bike—. |

Signed and Sealed this

Tenth Day of October, 2000

*Attest:*

Q. TODD DICKINSON

*Attesting Officer*

*Director of Patents and Trademarks*